United States Patent [19]

Vogt

[11] 4,238,046

[45] Dec. 9, 1980

[54] EASY OPENING TOP CLOSURE MEMBER FOR A CONTAINER

[76] Inventor: Kuno J. Vogt, 4250 1/2 Fairmont Ave., San Diego, Calif. 92105

[21] Appl. No.: 61,925

[22] Filed: Jul. 30, 1979

[51] Int. Cl.[3] ..... B65D 41/32

[52] U.S. Cl. ..... 220/269; 220/288; 220/345

[58] Field of Search ..... 220/265–270, 220/288, 336, 345; 222/541

[56] References Cited

U.S. PATENT DOCUMENTS 4,162,742 7/1979 Vogt ..... 220/345 X

*Primary Examiner*—George T. Hall

*Attorney, Agent, or Firm*—Charles C. Logan, II

[57] ABSTRACT

An easy opening top closure member for a container having a top member with an aperture of a predetermined configuration. The closure member for the aperture has an exterior portion finger gripping structure, and intermediate portion in the form of a disc member that closes the aperture, and an interior portion in the form of a flange that is connected to the bottom of the disc member. The exterior portion finger gripping structure extends upwardly from the intermediate portion and functions to provide structure that can be gripped by the fingers of the person opening the top closure member by a rotational twisting motion.

12 Claims, 9 Drawing Figures

EASY OPENING TOP CLOSURE MEMBER FOR A CONTAINER

BACKGROUND OF THE INVENTION

The invention relates in general to container structure and more specifically to an easy opening top closure member for a container.

The popularity of the conventional pop-top beverage container has caused the problem of littering resulting from improper disposal of the tear tab that is detached to the open container. These removable tear tabs which typically have sharp or rough metal edges, are frequently dropped on the ground as soon as the can is opened, thereby creating an unsightly and hazardous situation. Public criticism and dissatisfaction with the conventional pop-top beverage can, with its removable tear tab, has increased to the point where a number of jurisdictions have outlawed such beverage containers or are contemplating doing so.

A preferred solution to the problems created by the conventional pop-top would be an easy opening container which is manually operable by children as well as adults, which provides an effective pouring opening once opened, which presents no psychological barriers to opening or beverage consumption, which is readily producable, and which is economically feasible. While many designs of easy-opening containers have been proposed as substitutions for the pop-top, none is known which effectively meets all foregoing criteria to the satisfaction of the container manufacturer, the beverage packager, and the consumer of canned beverages.

One of the attempts to solve the littering problem is illustrated in U.S. Pat. No. 3,902,626. In the structure illustrated therein, the top of the container has had weakening indentations formed in the exterior surface to provide a fracturable web at the root of the indentation adapted to be fractured by inwardly directed pressure digitally applied against an integral outwardly projecting deflectable portion of the container component around the opening panel. This structure still has the drawback that the opening panel is pushed through the opening in the lid into the contents of the container thereby providing a danger of the opening panel being swallowed. Additionally as the opening panel is pushed through the top of the container there remains the risk of cutting or severing the fingertip as it is pushing the opening panel through the aperture formed in the top of the container.

Other attempts have been made to design nondetachable easy open flap and tab assemblies such as are illustrated in U.S. Pat. Nos. 3,938,693 and 4,039,100. The major problem with the structures illustrated in these patents is their costliness of manufacture. Both of these structures eliminate the littering problem and also the danger of cutting the finger which is used to open the top.

It is an object of the invention to provide a novel easy opening top closure member for a container that is non-detachable from the container.

It is also an object of the invention to provide a novel easy opening top closure member for a container that eliminates the danger of cutting one's finger when the top closure is opened.

It is also an object of the invention to provide a novel easy opening top closure member for a container that will not be deposited within the container in such a manner to provide a danger that the person drinking from the container may swallow the top closure member.

It is a further object of the invention to provide a novel easy opening top closure member for a container that is inexpensive to manufacture.

SUMMARY OF THE INVENTION

The easy opening top closure member is utilized with a container having a top member with an aperture of a predetermined configuration. The closure member for the aperture has an exterior portion finger gripping structure, an intermediate portion, and an interior portion. The exterior portion finger gripping structure extends upwardly from the intermediate portion and functions to provide structure that can be gripped by the fingers of the person opening the top closure member by a rotational twisting motion. The intermediate portion is in the form of a disc member that closes the aperture. The interior portion is in the form of a flange that is connected to the bottom of the disc member.

The finger gripping structure is shaped in the form of an annular ridge. The outer surface of the annular ridge slopes inwardly and it has a score line formed in it resembling a screw thread that circles the ridge in a helical path. The top surface of the annular ridge has at least two spirally rising sections each one of which has a finger pressure surface that can be gripped by the finger of the person opening the top closure member to give the closure member a rotational twisting motion. On one alternative embodiment a connecting member extends between the finger pressure surfaces that can be gripped between the fingers of the person opening the top closure member to aid in giving the closure member a rotational twisting motion. A second alternative embodiment utilizes tab members that are hinged to the respective spirally rising sections for its finger pressure surfaces.

The flange that is connected to the bottom of the disc member extends downwardly and outwardly therefrom. The flange is annularly shaped and its interior diameter is equal to or greater than the diameter of the aperture formed in the container top member.

The closure member is turned from one side of the container top member into the aperture therein until seated with the aperture rim embedded in the closure members intermediate portion. The aperture rim acts as a male connector that mates with the score-line formed in the outer surface of the annular ridge which is the female thread. This is the structure of the container top member that is then attached to the top of a beverage container by one of the normal state of the art processes. At this point the container is full of the desired beverage.

When it is desired to open the container, the finger gripping structure extending upwardly from the intermediate portion is gripped, and by turning the closure member forces the aperture rim to move into the interior flange portion. When the point is reached where the inside diameter of the interior annular flange is equal or greater than the aperture diameter, the metal rim shears through the flange thickness separating it from the intermediate disc member portion. Complete separation is prevented by a thick vertical section running through the height of the closure member. The entire closure member can now be swung away from the aperture and wedged into one side of it. When this occurs the bottom flange remains on one side of the container top member and the finger gripping structure and the disc member remain on the other side.

The closure member is made of a suitable plastic or metal material that can be used with a beverage can that is made of metal or even a blow-molded one piece plastic can such as recently been manufactured.

DESCRIPTION OF THE PREFERRED EMBODIMENTS

Figure 1:
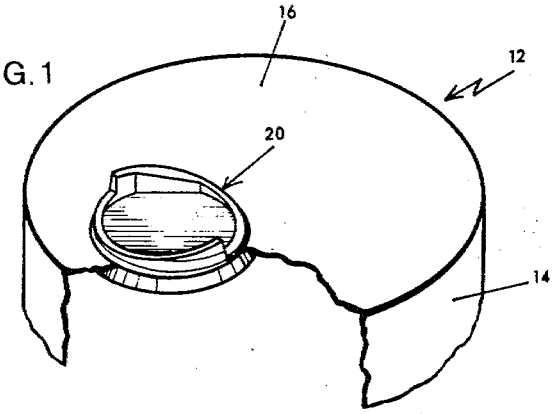
FIG. 1 is a partial perspective view of the top of a can fitted with the novel closure member.
Figure 2:
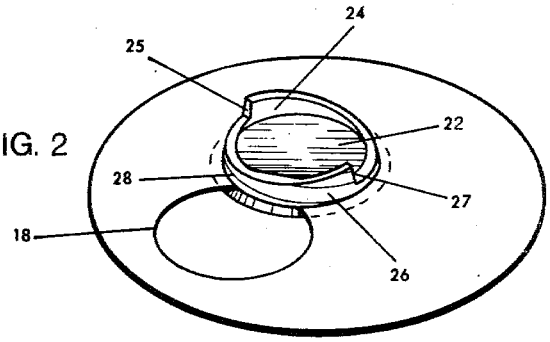
FIG. 2 is a perspective view illustrating the top member of a container with the novel closure member in its open position.
Figure 3:
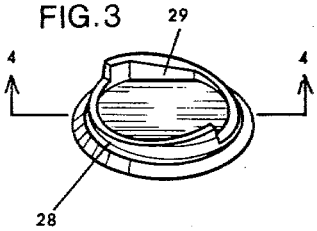
FIG. 3 is a perspective view of the novel closure member.
Figure 4:
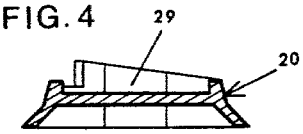
FIG. 4 is a cross-sectional view taken along lines 4—4 of FIG. 3.

Referring to FIGS. 1–7, the novel closure member will be described. A container made from plastic or metal generally designated numeral 12 and it has a side wall 14 and a top member 16. An aperture 18 of a predetermined configuration is formed in the top member and into this aperture is fitted the closure member 20.

The closure member 20 has exterior finger gripping structure in the form of an annular ridge 21, an intermediate portion 22 in the form of a disc member that closes aperture 18, and an interior portion in the form of a downwardly and outwardly depending annular flange 23.

The outer surface of annular ridge 21 slopes inwardly in a tapering manner. This outer surface also has a score line 28 formed in it that resembles a screw thread that circles there about in a helical path. The top surface of the annular ridge has at least two spirally rising sections 24 and 26, each which has a finger pressure surface 25 and 27, respectively, that can be gripped by the fingers of the person opening the top closure member to give the closure member a rotational twisting motion.

Figure 5:
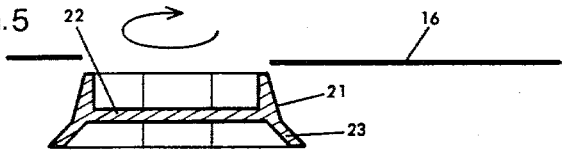
FIG. 5 is a schematic view illustrating the closure member prior to its insertion into the container top member.
Figure 6:
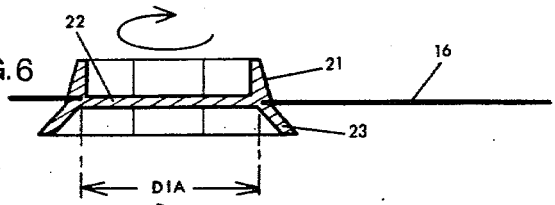
FIG. 6 is a schematic view illustrating the closure member after it has been inserted into the container top member.
Figure 7:
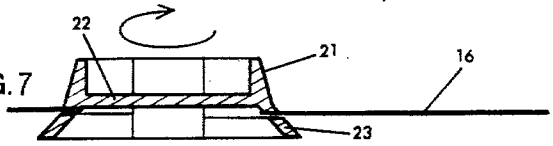
FIG. 7 is a schematic view illustrating the closure member after it has been rotated sufficiently to open it.

In FIGS. 5–7, the manner in which the top closure member 20 is inserted into the top lid 16 is illustrated. In the first stage, the top closure member is twisted to insert it into the top member 16 as illustrated in FIG. 5. In FIG. 6 the top closure member is illustrated as it would be while a beverage is contained in the container. In FIG. 7 after continued twisting motion to the top closure member it can be seen how the metal edges of the aperture 18 cut through the bottom flange wall of the closure member. The vertical thickened section 29 extends throughout the entire height of the closure member to prevent the interior portion from being severed from the rest of the closure member during the opening operation.

Figure 8:
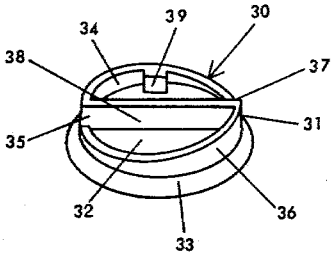
FIG. 8 is a perspective view of a first alternative embodiment of the closure member.

A first alternative closure member 30 is illustrated in FIG. 8. It has an annular ridge 31, a disc member 32, and an annular flange 33. Spirally rising sections 34 and 36 of the annular ridge each have a finger pressure surface 35 & 37, respectively, and there is a connecting member 38 extending between these finger pressure surfaces that can be gripped between the fingers of the person opening the top closure member to aid in giving the closure member a rotational twisting motion. A thickened vertical section 39 extends throughout the entire height of the closure member.

Figure 9:
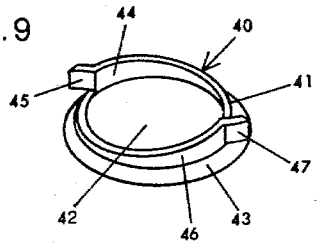
FIG. 9 is a perspective view illustrating a second alternative embodiment of the closure member.

A second alternative closure member 40 is illustrated in FIG. 9. It has an annular ridge 41, a disc member 42, and an annular flange 43. The annular ridge has two spirally rising sections 44 & 46 each one of which has a finger pressure surface 45 & 47 that are in the form of tab members that are hinged to the respective spirally rising sections.

What is claimed is:

1. An easy opening top closure member for a container comprising:

a container top member having an aperture of a first predetermined configuration, a closure member for said aperture having exterior portion finger gripping means, an intermediate portion, and an interior portion, said exterior portion finger gripping means extending upwardly from said intermediate portion and functioning to provide structure that can be gripped by the fingers of the person opening the top closure member by a rotational twisting motion, said intermediate portion being in the form of a disc member that closes said aperture, and said interior portion being in the form of a flange that is connected to the bottom of said disc member.

2. An easy opening top closure member as recited in claim 1 wherein said finger gripping means is in the form of an annular ridge.

3. An easy opening top closure member as recited in claim 2 wherein the outer surface of said annular ridge slopes inwardly.

4. An easy opening top closure member as recited in claim 3 wherein said outer surface of said annular ridge has a score line formed in it resembling a screw thread that circles in a helical path.

5. An easy opening top closure member as recited in claim 2, wherein, the top surface of said annular ridge has at least two spirally rising sections each one of which has a finger pressure surface that can be gripped by the fingers of the person opening the top closure member to give the closure member a rotational twisting motion.

6. An easy opening top closure member as recited in claim 5, further comprising a connecting member extending between said finger pressure surfaces that can be gripped between the fingers of the person opening the top closure member to aid in giving the closure member a rotational twisting motion.

7. An easy opening top closure member as recited in claim 5, wherein, said finger pressure surfaces are tab members that are hinged to said respective spirally rising sections.

8. An easy opening top closure member as recited in claim 1, wherein, said closure member has a thickened vertical section extending throughout its entire height to prevent said interior portion from being severed from the rest of said closure member during the opening operation.

9. An easy opening top closure member as recited in claim 1, wherein, said flange depends downwardly from the bottom of said disc member.

10. An easy opening top closure member as recited in claim 9, wherein, said flange also depends outwardly from the bottom of said disc member.

11. An easy opening top closure member as recited in claim 1, wherein, said flange is annularly shaped.

12. An easy opening top closure member as recited in claim 11, wherein, the interior diameter of said annular flange is equal to or greater than the diameter of the aperture.

* * * * *